US005121432A

United States Patent [19]

Gilham et al.

[11] Patent Number: 5,121,432

[45] Date of Patent: Jun. 9, 1992

[54] FRANKING MACHINE, WITH PRINTING DEVICE EXTERNAL TO SECURE HOUSING

[75] Inventors: Dennis T. Gilham, Brentwood; Raymond J. Herbert, Leigh-on-Sea, both of United Kingdom

[73] Assignee: Alcatel Business Systems Limited, United Kingdom

[21] Appl. No.: 507,493

[22] Filed: Apr. 11, 1990

[30] Foreign Application Priority Data

Apr. 13, 1989 [GB] United Kingdom ..... 8908391

[51] Int. Cl.[5] ..... H04K 1/00

[52] U.S. Cl. ..... 380/51; 380/3; 364/464.02; 364/918.52; 400/104

[58] Field of Search ..... 380/3, 23, 25, 51; 364/464.02, 918.52; 235/432, 101; 400/104, 668

[56] References Cited

U.S. PATENT DOCUMENTS

| | | | |
|---|---|---|---|
| 4,253,158 | 2/1981 | McFiggan | 380/23 |
| 4,335,441 | 6/1982 | Baumann et al. | 364/464.02 X |
| 4,813,912 | 3/1989 | Chickneus et al. | 364/464.02 |
| 4,934,846 | 6/1990 | Gilham | 235/432 X |

FOREIGN PATENT DOCUMENTS

| | | | |
|---|---|---|---|
| 0331352 | 9/1989 | European Pat. Off. | 364/464.02 |

*Primary Examiner*—Tod R. Swann

*Attorney, Agent, or Firm*—Shoemaker and Mattare, Ltd.

[57] ABSTRACT

A franking machine is disclosed in which the accounting and control circuits of the meter are housed in a secure housing and a printing device for printing a franking impression is located exterior to the secure housing and is connected to the accounting and control circuits. Strings of print data sent to the printing device are returned in a succeeding print cycle to a check circuit in the housing to check integrity of the print data received by the printing device. If desired the print data strings may include a security code. In order to detect if the printing device has been disconnected from the meter, the meter includes a circuit to send a pulse train to the printing device via the connection for print data and to receive a pulse train from the printing device. The circuit compares the pulse trains and if the comparison is unsuccessful inhibits further franking operations.

15 Claims, 3 Drawing Sheets

FRANKING MACHINE, WITH PRINTING DEVICE EXTERNAL TO SECURE HOUSING

BACKGROUND OF THE INVENTION

This invention relates to franking machines and in particular to such machines provided with franking printing means controlled by electronic accounting and control means to maintain an accounting record of data relating to franking impressions which have been printed.

Known franking machines utilise a mechanically operated print drum to print franking impressions. The print drum carries settable print wheels for printing the value of franking and the date of franking. The setting of the print wheels, and hence the value of the franking impression printed, is controlled by a franking meter which includes means for carrying out accounting functions in respect of usage of the meter in franking operations. Usually the meter includes a descending register which is reset to record a value of credit available for use in franking and in each franking operation this register is decremented by the value of franking impression printed. The accumulated value of franking used in franking operations is registered in an ascending register, this register being incremented in each franking operation by the value of franking printed Mechanical interlocks are provided to prevent fraudulent attempts to operate the printing mechanism independently of control by the meter and to prevent fraudulent attempts to reset the print wheels to print a franking value different from that registered by the meter.

With the availability of electronically operated printing devices such as thermal print heads and ink jet print heads, it is desirable to replace the mechanical drum print mechanism with electronically operated print device in order to provide greater flexibility in printing and to avoid the need for complex and expensive electro-mechanical interfaces between the electronic accounting and control circuits and the mechanical print elements of the drum printer. However such electronically operated printing devices could be operated by the external application of electrical signals to the print head elements or the drive circuits thereof and hence may be capable of being operated in a fraudulent manner. Accordingly measures must be taken to ensure security of the printing of franking impressions and the accounting thereof. One method of overcoming this problem is to house not only the meter circuits but also the printer, the drive circuits therefore and the interconnections between the meter and the printer in a secure housing. This has the disadvantage that, if a fault arises in the printer, repair of the fault requires access to the secure housing and as a result the postal authority may require the integrity of the accounting records maintained in the meter to be verified prior to re-use of the machine. It would be advantageous to place within the secure housing only those circuits concerned with performing functions for which there is a need for security and to house other elements of the franking machine externally of the secure housing thereby reducing the occasions when there is a need for access to the secure housing and to take measures to ensure that elements of the franking machine, such as the printer, housed externally of the secure housing cannot be operated in a manner to cause printing of a fraudulent franking.

SUMMARY OF THE INVENTION

According to one aspect of the invention a franking machine includes electronic accounting and control circuits operative to maintain a record of data relating to franking operations; a secure housing containing said accounting circuits; a printing device located externally of the secure housing for printing franking impressions on mail items; a connection from the accounting and control circuits in the secure housing to the printing device to carry a signal from the accounting and control circuits to the printing device; means to return said signal from the printing device to the accounting circuits; and detection means in the secure housing operative to compare the signal carried from the accounting and control circuits by the connection with the signal returned to the accounting and control circuits from the printing device; said detection means being operative to generate a signal effective to inhibit operation of the accounting and control circuits in response to failure of said comparison.

According to another aspect of the invention a franking machine includes electronic accounting circuits operative to maintain a record of data relating to franking operations; a secure housing containing said accounting circuits; a printing device located externally of the secure housing for printing franking impressions on mail items; a connection from the accounting circuit to the printing device to carry strings of print data signals from the accounting circuits to the printing device to control the printing device to print a franking of a selected value; means to return said strings of print data signals from the printing device to the accounting circuits; said accounting circuits including comparison means to compare each string of print data signals from the accounting circuit with a corresponding string of print data signals returned from the printing device; said accounting circuit being operative in response to a failure in said comparison to terminate printing of the franking impression.

BRIEF DESCRIPTION OF THE DRAWING

An embodiment of the invention will now be described by way of example in which.

DESCRIPTION OF THE PREFERRED EMBODIMENT

Figure 1:
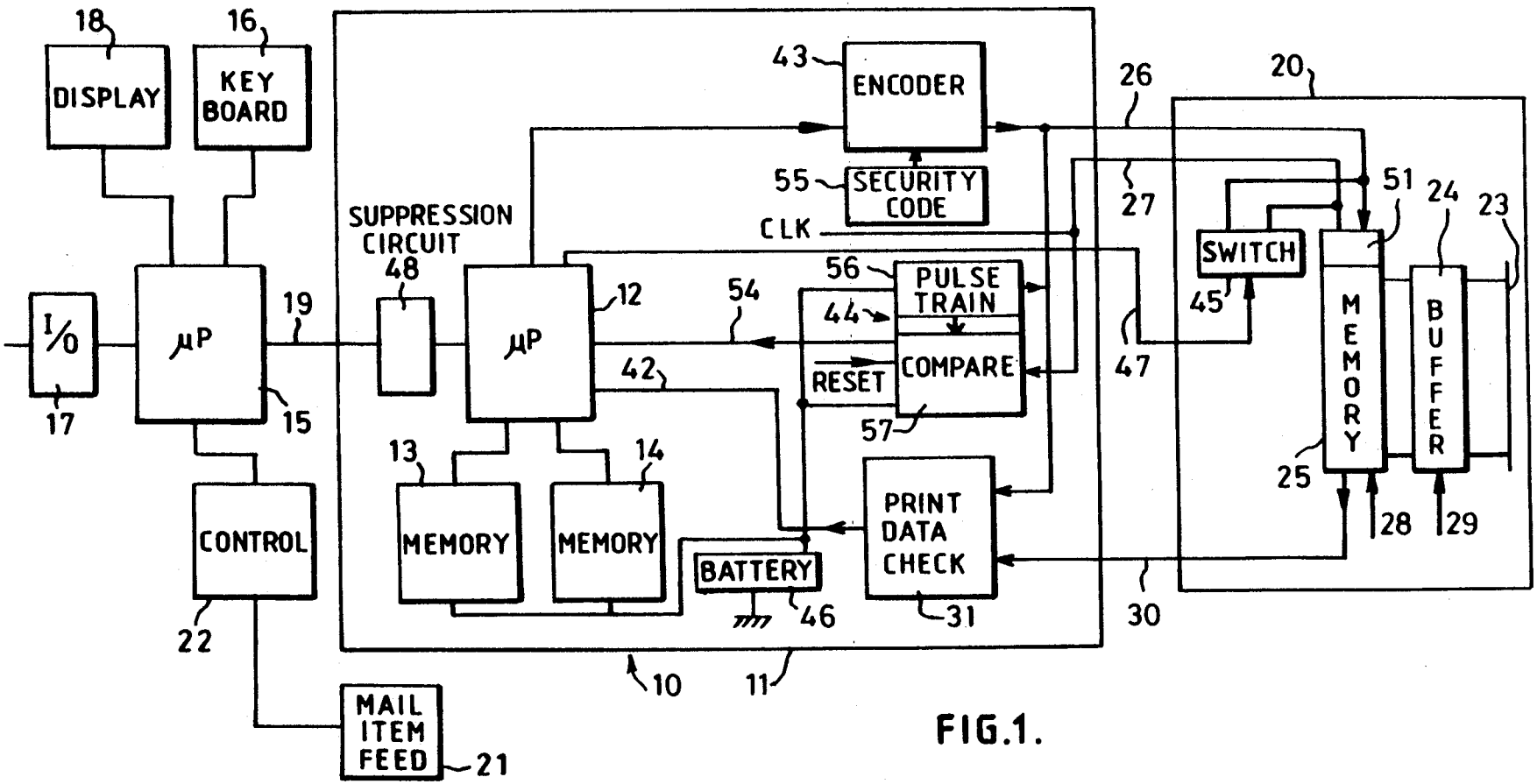
FIG. 1 is a block diagram of a franking machine.

Referring first to FIG. 1, a franking machine includes a franking meter 10 having accounting and control circuits housed in a secure housing 11. The accounting and control circuits include a microprocessor 12 and non-volatile memories 13, 14 for storing accounting data. Memory 13 includes descending and ascending registers for registering respectively the value of credit available for franking and the accumulated value of franking used. The memory also includes an items count register for registering the number of mail items franked and a high items count register for registering the number of mail items franked with a franking value exceeding a predetermined value. The aforementioned registers of memory 13 are duplicated so that the data is registered in duplicate. The memory 14 is similar to memory 13 and includes a further set of registers in duplicate thereby permitting the credit value, accumulated tote value, items count and high items count each to be stored in four different registers. This replication of registers ensures that the integrity of the stored data can be verified and in the event of corruption of data in any one of the registers the data can be restored from that stored in the corresponding registers.

The franking machine also includes, externally of the secure housing 11, a further microprocessor 15 for receiving input data entered by a user of the machine on a keyboard 16 or received via a communication interface 17. The microprocessor 15 controls a display device 18 to display data and information signals to the user of the machine. To enable communication between the microprocessors 12 and 15 a bus connection 19 is provided. A print head 20 operable to print franking impressions on mail items is connected to the circuits in the secure housing as will be described hereinafter. Feeding means 21 including a drive motor is provided to feed mail items one at a time past the print head to enable franking impressions to be printed thereon. The drive motor of the feeding means is energised under control of a control circuit 22 operated by the microprocessor 15.

The electronically operated print head 20 comprises a row of thermally operated print elements 23 which are heated by passage of electric current therethrough controlled by the data content of corresponding stages of a print buffer 24. For example, a binary '1' in a stage of the print buffer results in the corresponding print element being energised and heated whereas a binary '0' leaves the corresponding print element un-energised. A serial memory 25 receives print data serially via a print data input line 26 from the meter 10, the print data being clocked into the memory by clock pulses on line 27. The stages of the serial memory 25 correspond to and are connected by gates to the stages of the print buffer 24. When the serial memory is loaded with a string of print data, opening of the gates by a load print data control signal 28 causes the print data to be read from the serial memory and to be loaded in parallel to the stages of the print buffer 24 to set the stages thereof to correspond to the string of print data. A print strobe signal 29 applied to the print buffer causes the print elements 23 to be energised in dependence upon the binary value of the contents of the corresponding stages of the print buffer and hence selected print elements are heated to print dots along a line in positions determined by the print data. When print data corresponding to a line of printing is clocked into the serial memory 25, the previous content of the memory, corresponding to a previous line of printing is clocked out on a serial data output line 30. Thus as data corresponding to the dot pattern for one line is clocked into the serial memory, the data corresponding to the dot pattern for the previous line is clocked out on line 30.

Figure 2:
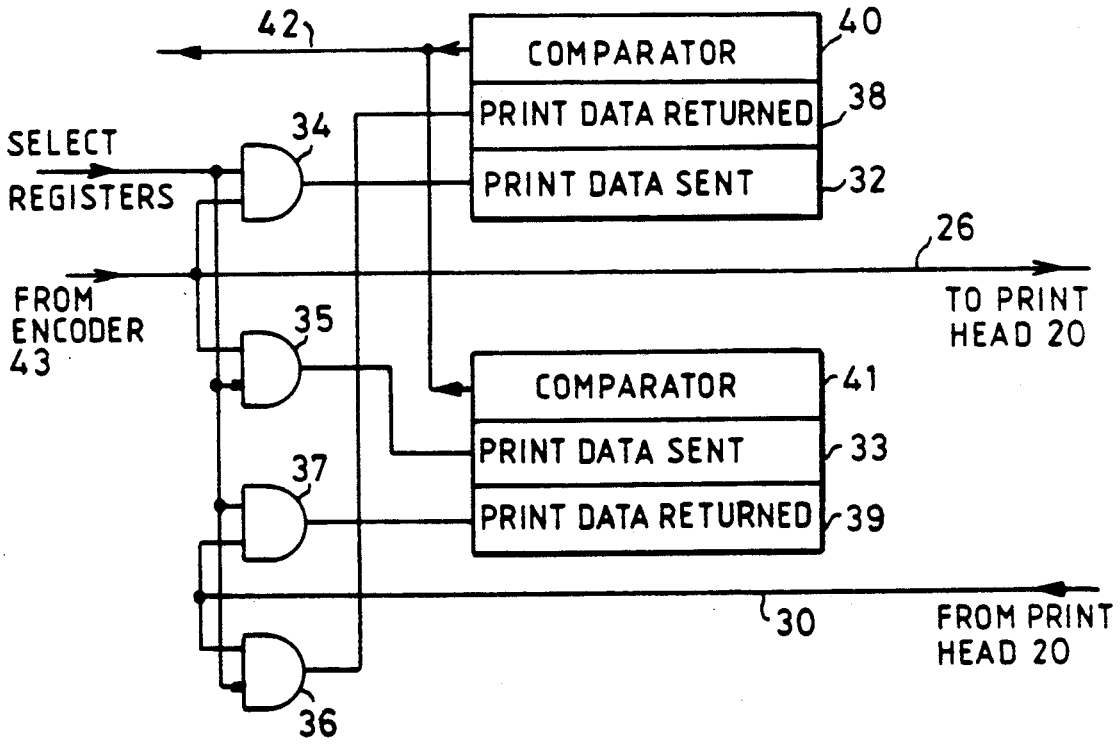
FIG. 2 is a block diagram of a comparison circuit.

The meter includes a check circuit 31 which receives the print data sent to the print head on line 26 and the data clocked out on line 30 from the serial memory 25 and carries out a comparison to test for identity between the print data sent, on line 26, and data returned on line 30. Due to the data string returned from the serial memory being delayed relative to the sending of that data string to the serial memory the check circuit 31 includes means to store the string of print data sent until the returned data string is received. This may be effected conveniently by providing duplicate sets of registers for storing the print data strings and the returned data strings and duplicate comparison circuits operated alternately to compare corresponding sent and returned data strings. The check circuit is shown in more detail in FIG. 2. The string of data corresponding to the dot pattern for a line transmitted to the print head on print data line 26 also is routed to one of a pair of registers 32, 33 of the check circuit 31 by gates 34, 35. The string of data read out serially from the serial memory 25 onto line 30 is routed by gates 36, 37 to one of a pair of registers 38, 39. The gates 34, 35 are operated to route the print data strings alternately to the registers 32, 33 and similarly the gates 36, 37 are operated to route the returned data strings alternately to the registers 38, 39 such that corresponding sent and returned strings are routed either to registers 32 and 38 or 33 and 39 respectively. Thus, for example print data strings representing the dot patterns of odd numbered lines are loaded into register 32 while print data strings representing the dot patterns of even numbered lines are loaded into register 33. A pair of comparators 40, 41 are operated aternately to compare the contents of the registers 32, 38 and registers 33, 39 respectively. If a returned data string corresponding to a sent print data string has identity with that sent print data string, the comparator 40 or 41 outputs a verification signal on line 42 to the microprocessor 12 to indicate that the print head received the correct print data string. On the other hand if the comparator does not find identity the verification signal is not output and the microprocessor terminates the printing of the franking operation and inhibits further use of the meter.

Figure 4:
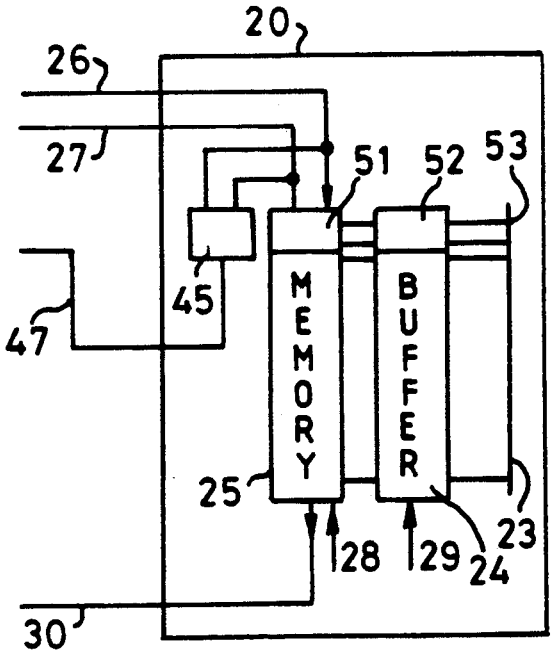
FIG. 4 shows a modification of the print head circuit.

While the circuits described hereinbefore ensure the integrity of the print data strings received by the serial memory of the print head, it may be desirable to provide an additional security to these data strings. For this purpose, the meter 10 includes an encoding device 43 operative to add a security code 55 to the print data strings. The print data strings would each include the security code at a predetermined position within the string. To accommodate the resulting longer strings, the serial memory 25 is provided with additional stages 51 which are not connected to the print buffer register 24. The security code is varied in a random or non predictable manner. The code may remain unaltered for the duration of printing an individual franking impression or may change during the printing of a franking impression. The code may consist of a random group of binary digits or may be formed from a combination of a random number and all or part of the string of print data. If it is desired to print the security code on the mail items the print buffer is provided with additional stages 52 connected to those stages 51 of the serial memory in which the security code is stored and corresponding print elements 53 are provided as shown in FIG. 4. Instead of checking the entire data block i.e. the print data and the security code sent to the print head, the check may be carried out on only part of the data block. For example the check may be carried out in respect of the security code only. Accordingly the registers 32 and 33 would store the security code sent to the print head and the registers 38 and 39 would store the security code returned from the print head. Checking only a part of the data block would enable economies to be made in the size of the registers and comparator circuits. If desired the entire data block comprising the print data and security code may be returned from the serial memory 25 to the print data check circuit 31, the print data being discarded and the security code being entered into the registers of the check circuit 31. Alternatively the circuits in the print head may be arranged to return only the security code on line 30 to the check circuit 31.

Instead of checking the data blocks corresponding to each line, which as described hereinbefore requires the provision of two sets of registers and comparator circuits, checking may be carried out in respect of data blocks corresponding to alternate lines of print data. Accordingly this would require only a single set of registers and a single comparator circuit.

The security measures described hereinbefore are effective to ensure detection of fraudulent attempts to operate the print head by means of signals applied externally to the print head or drive circuits thereof while the print head remains connected to the meter. However it may be possible to disconnect the print head from the meter in which case the print head could be operated independently of the meter. Accordingly the meter may be provided with means to detect any attempt to disconnect. Even temporarily, the print head from the meter. The meter is provided with a connection check circuit 44 which includes a pulse train generator 56 to apply a pulse train to the print data line 26. The print head includes a transistor switch 45 connected between the print data line 26 and the clock line 27. This transistor switch is normally in a low resistance state so that the print data line and clock line are interconnected. As a result the pulse train from the check circuit 44 on the print data line is returned on the clock line 27. The check circuit 44 is connected to the clock line 27 to receive the returned pulse train and includes a comparison circuit 57 to compare the generated pulse train applied to the line 26 with the pulse train returned on clock line 27. If there is a match between the sent and received pulse trains the check circuit generates a signal on line 54 having a state indicating that the connection between the print head and meter is secure. However if at any time the comparison between the pulse trains fails, the state of the signal from the check circuit on line 54 changes to indicate that the connection has been broken and the signal remains in this state until the check circuit is reset by access to the secure housing. When the franking meter is in a franking mode of operation, prior to carrying out any franking the microprcessor 12 tests the state of the signal from the check circuit. If the signal on line 54 has a state indicating that the print head connection has been broken the microprocessor is inhibited from continuing the franking mode of operation. In its simplest form the check circuit may generate a uniform non-varying pulse train. However to prevent attempts to simulate the pulse train from an external source it is preferred that the check circuit generate a pulse train which varies in a non-uniform manner. It will be appreciated that the check circuit must remain operative even when the franking meter is switched off or disconnected from a mains electricity power source. Therefore the check circuit is permanently powered by a back up battery 46. This battery may be the same as that required to permanently power the non-volatile memories 13, 14. The interconnection of the print data and clock lines by the transistor switch 45 in its low resistance state prevents loading of print data into the serial memory. When a franking operation is to be performed the transistor 45 is switched to a high resistance state by a control signal on line 47. Thus any disconnection of the print head from the meter, except during the period of a franking operation will be detected by the check circuit 44. If desired the testing of the connections between the franking meter and the print head may also be carried out during franking operations, the tests being carried out in suitable intervals between sending print data to the print head. While this provides security against attempts to disconnect the print head at any time, sufficient security may be provided by holding the transistor switch at a high resistance state for the duration that the franking machine is powered and allowing the switch to revert to its normal low resistance state when the machine is not powered by the mains electricity supply thereby detecting disconnection of the print head when the machine is not powered.

Figure 3:
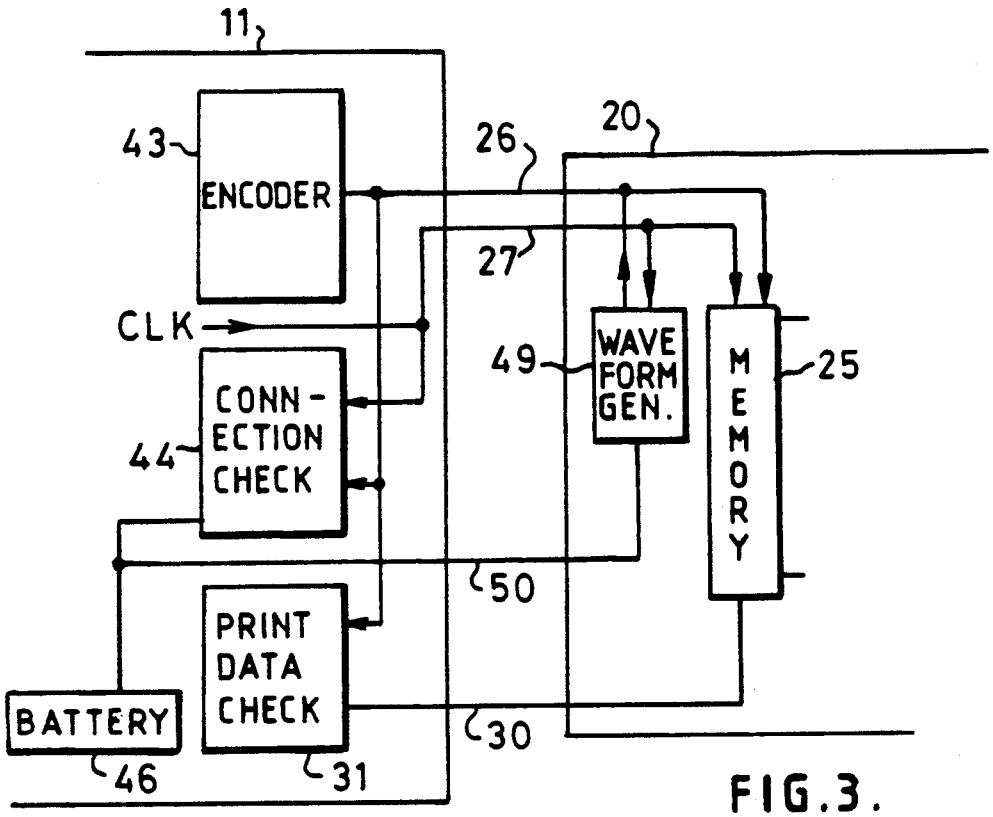
FIG. 3 is a modification of a part of the block diagram of FIG. 1.

A higher degree of security for the connections between the franking meter and the print head may be provided by the modified circuit shown in FIG. 3. The connection check circuit 44 is the same as that of FIG. 1 and this generates a pseudo-random waveform. A similar pseudo-random waveform generator 49 is provided on the print head 20. A master clock or synchronising signal is generated in the franking meter and this is utilised to clock the pseudo-random waveform generator 56 in circuit 44 and is transmitted by the line 27 to the generator 49 on the print head to clock generator 49. A system reset is generated every complete cycle of the pseudo-random pulse train to ensure that the pulse trains from circuit 56 and generator 49 are maintained synchronised. The pseudo-random pulse train from generator 49 is transmitted by line 26 to the comparison circuit 57 where it is compared with the pulse train generated by generator 56. It will be appreciated that the pulse train is transmitted on the line 26 which carries print data signals during franking operations in order to ensure that this line is not disconnected. Where required steering circuits are provided to steer signals along the required paths. The generator 49 on the print head is powered from the battery 46 by means of line 50. When it is desired to carry out a franking operation, the value of franking desired is entered on the keyboard and the microprocessor 15 passes this data to the microprocessor 12 in the secure housing and also causes the data to be displayed on the display device 18. The microprocessor 12 carries out a series of tests to check inter alia the state of the signal of the check circuit 44 and that the descending register is registering a credit value in excess of the value of desired franking. If all the tests are satisfactory, the microprocessor switches the transistor switch 45 to a high resistance state and outputs, one string at a time, strings of print data to the encoding device 43. A security code is added to the print data strings and the strings are transmitted to the print head and clocked into the serial memory for printing of lines of dots by the print elements. The mail item is fed by the feeding means 21 so that successive lines of printed dots build up a complete franking impression. Upon completion of the franking impression the mail item is ejected by the feeding means and the meter circuits return to a state to await the initiation of the next franking operation.

In order to prevent corruption of data in the circuits of the meter in the secure housing by the application of over-voltage signals, the bus connection 19 between the exterior of the housing and the microprocessor 12 within the housing is protected by suppression circuits 48 using transorbs. Generally there is no need to protect the connections between the meter module 10 and the print head 20, but if desired these also may be protected by suppression circuits.

We claim:

1. A franking machine including an electronic accounting circuit operative to maintain a record of data relating to franking operations;

a secure housing containing said accounting circuit;

a printing device located externally of said secure housing for printing franking impressions on mail items;

a connection from said accounting circuit to said printing device to carry a succession of strings of print data signals from said accounting circuit to said printing device to control said printing device to print a franking of a selected value;

said printing device including a memory and means to enter a next string of said succession of print data signals into said memory and to read a preceding string of said succession of print data signals from said memory;

means to return said read out preceding string of print data signals from said printing device to said accounting circuit;

said accounting circuit including comparison means to compare each string of print data signals from said accounting circuit with a corresponding string to print data signals returned from said printing device;

said accounting circuit being operative in response to a failure in said comparison to terminate printing of the franking impression.

2. A franking machine as claimed in claim 1 wherein the memory comprises a shift register.

3. A franking machine as claimed in claim 1 wherein the comparator means includes at least one register to store the string of print data signals sent to the printing device until the corresponding string of returned print data signals is received back from the printing device.

4. A franking machine as claimed in claim 3 wherein the comparator means includes first and second registers operable to store respectively one string and a next succeeding string of a succession of strings of print data sent to the printing device; a third register to store one string of returned print data signals corresponding to said one string of print data signals sent to the printing device a fourth register to store a next succeeding string of returned print data signals corresponding to said next string of print data signals sent to the printing device; first comparison means operative to compare the contents of the first and third registers and second comparison means operative to compare the contents of the second and fourth registers, each comparison means being operative in response to a successful comparison to output a verification signal to the accounting circuit.

5. A franking machine including an electronic accounting circuit operative to maintain a record of data relating to franking operations;

a secure housing containing said accounting circuit;

a printing device located externally of said secure housing for printing franking impressions on mail items;

as connection from said accounting circuit to said printing device to carry a succession of strings of print data signals from said accounting circuit to said printing device to control said printing device to print franking of a selected value;

means to return said strings of print data signals from said printing device to said accounting circuit;

said accounting circuit including comparison means to compare each string of print data signals from said accounting circuit with a corresponding string of print data signals returned from said printing device;

said accounting circuit being operative in response to a failure in said comparison to terminate printing of the franking impression;

generator means in said secure housing operative to generate a generated signal;

a first connecting line carrying said generated signal from said secure housing to said printing device;

a second connecting line carrying said generated signal from said printing device back to the interior of said secure housing;

detector means in said secure housing connected to said second connecting line and operative in response to an absence of said generated signal on said second connecting line to generate an inhibit operation of the franking machine.

6. A franking machine as claimed in claim 5 wherein the generated signal comprises a train of pulses.

7. A franking machine as claimed in claim 5 wherein the generator means is operative to generate a non-uniformly varying generated signal and the detector means is operative to compare the generated signal with the signal on the second connecting line; said detector means being operative in response to failure of the comparison to generate the inhibit signal.

8. A franking machine as claimed in claim 5 wherein one of the first and second connecting lines comprises the connection carrying print data signals to the printing device; and including switch means located at the printing device interconnecting the first and second lines by a low resistance connection and wherein during a franking operation the switch means is controlled to have a high resistance and the generator means is rendered inoperative.

9. A franking machine including an electronic accounting circuit operative to maintain a record of data relating to franking operations;

a secure housing containing said accounting circuit;

a printing device located externally of said secure housing for printing franking impressions on mail items;

a connection from said accounting circuit to said printing device to carry strings of print data signals from said accounting circuit to said printing device to control said printing device to print a franking of a selected value;

means to return said strings of print data signals from said printing device to said accounting circuit;

said accounting circuit including comparison means to compare each string of print data signals from said accounting circuit with a corresponding string of print data signals returned from said printing device;

said accounting circuit being operative in response to a failure in said comparison to terminate printing of the franking impressions;

generator means in said secure housing operative to generate a signal;

a first connecting line carrying said signal from said secure housing to said printing device;

a second connecting line carrying said signal from said printing device back to the interior of said secure housing;

detecor means in said secure housing connected to said second connecting line and operative in response to an absence of said signal on said second connecting line to generate an inhibit signal effective to inhibit operation of the franking machine;

one of the first and second connecting lines comprising said connection carrying print data signals to the printing device;

and further including switch means located at said printing device interconnecting said first and second lines by a low resistance connection and wherein during a franking operation said switch means is controlled to have a high resistance, said generator means is rendered inoperative, one of said first and second connecting lines carries print data signals and the other connecting line carries clock signals to control entry and read out of signals to and from a memory in said printing device.

10. A franking machine including electronic accounting and control circuits operative to maintain a record of data relating to franking operations;

a secure housing containing said accounting and control circuits;

a printing device located externally of said secure housing for printing franking impressions on mail items;

a connection from said accounting and control circuits in said secure housing to said printing device to carry a signal from said accounting and control circuits to said printing device;

means to return said signal from said printing device to said accounting and control circuits;

and detection means in said secure housing operative to compare said signal carried from said accounting and control circuits by said connection with said signal returned to said accounting and control circuits from said printing device;

said detection means being operative to generate a signal effective to inhibit operation of said accounting and control circuits in response to failure of said comparison;

first generator means in said secure housing operative to generate a first pseudo-random signal;

a second generator means in said printing device operative to generate a second pseudo-random signal corresponding to said first signal;

means generating a synchronising signal to control said first generator means;

a first connecting line carrying said synchronising signal between said secure housing and said printing device to synchronise the first and second generator means;

a second connecting line carrying said second pseudo-random signal from said printing device to the interior of said secure housing;

detector means in said secure housing connected to said second connecting line and operative in response to a difference between signals on said second connecting line and said first pseudo-random signal to generate an inhibit signal effective to inhibit operation of the franking machine.

11. A franking machine including an electronic accounting circuit operative to maintain a record of data relating to franking operations;

a secure housing containing said accounting circuit;

a printing device located externally of said secure housing for printing franking impressions on mail items;

a connection from said accounting circuit to said printing device to carry strings of print data signals from said accounting circuit to said printing device to control said printing device to print a franking of a selected value;

means to return said strings of print data signals from said printing device to said accounting circuit;

said accounting circuit including comparison means to compare each string to print data signals from said accounting circuit with a corresponding string of print data signals returned from said printing device;

said accounting circuit being operative in response to a failure in said comparison to terminate printing of the franking impression;

first generator means in said secure housing operative to generate a first pseudo-random signal a second generator means in said printing device operative to generate a second pseudo-random signal corresponding to said first signal;

means generating a synchronising signal to control said first generator means;

a first connecting line carrying said synchronising signal between said secure housing and said printing device to synchronise said first and second generator means;

a second connecting line carrying said second pseudo-random signal from said printing device to the interior of said secure housing;

detector means in said secure housing connected to said second connecting line and operative in response to a difference between signals on said second line and said first pseudo-random signal to generate an inhibit signal effective to inhibit operation of the franking machine.

12. A franking machine including an electronic accounting circuit operative to maintain a record of data relating to franking operations;

a secure housing containing said accounting circuit;

a printing device located externally of said secure housing and controlled by strings of print data signals transmitted from the accounting circuit to print franking impressions on mail items;

a transmission path from the accounting circuit to the printing device to convey said strings of print data signals;

generator means in said secure housing to generate a security signal and to transmit said security signal over said transmission path to the printing device in intervals between said transmission of said strings of print data signals to said printing device;

detection means located in said secure housing;

transmission means to return said security signal from the printing device to said comparison means;

said detection means being operative to inhibit transmission of print data strings to the printing device in response to absence of a returned security signal corresponding to said transmitted security signal.

13. A franking machine as claimed in claim 12 including comparison means located in the secure housing;

a return path to convey the strings of print data signals, received by the printing device over the transmission path, to said comparison means;

said comparison means being operative to compare a said string of print data signals transmitted by the accounting circuit with a string of print data signals conveyed to said comparison means by said return path and corresponding to said transmitted string of print data signals and in response to said comparison being successful outputting a verification signal to the accounting circuit.

14. A franking machine including an electronic accounting circuit operative to maintain a record of data relating to franking operations;

a secure housing containing said accounting circuit;

a printing device located externally of said secure housing for printing franking impressions on mail items;

a connection from said accounting circuit to said printing device to carry a succession of strings of print data signals from said accounting circuit to said printing device to control said printing device to print franking of a selected value;

means to return said strings of print data signals from said printing device to said accounting circuit;

said accounting circuit including comparison means to compare each string of print data signals from said accounting circuit with a corresponding string of print data signals returned from said printing device;

said accounting circuit being operative in response to a failure in said comparison to terminate printing of the franking impression;

wherein said printing device includes a number of printing elements disposed in a row and selectively operable in a succession of printing cycles to print row by row said franking impression;

wherein each said string of print data signals includes a plurality of print data signals corresponding in number to the number of said printing elements and a plurality of signals constituting a security code;

and further including a register having a first group of storage locations corresponding in number to the number of said plurality of print data signals and a second group of storage locations corresponding in number to said plurality of security signals constituting said security code;

entry means to enter said string of print data signals into said shift register such that said print data signals are stored in said first group of storage locations and said security signals are stored in said second group of storage locations; and means connecting said storage locations of said first group of corresponding ones respectively of said printing elements to enable said print data signals to control operation of said printing elements.

15. A franking machine as claimed in claim 14 wherein the register is a shift register; the storage locations of the second group are located relative to the storage locations of the first group in positions corresponding to serial positions of the security signals relative to the print data signals in the print data strings and wherein the entry means enters the print data strings serially into the shift register.

* * * * *